US009776061B2

(12) United States Patent
Nussbaum

(10) Patent No.: US 9,776,061 B2
(45) Date of Patent: Oct. 3, 2017

(54) TRAINING DEVICE

(71) Applicant: Matthew T Nussbaum, New Orleans, LA (US)

(72) Inventor: Matthew T Nussbaum, New Orleans, LA (US)

( * ) Notice: Subject to any disclaimer, the term of this patent is extended or adjusted under 35 U.S.C. 154(b) by 25 days.

(21) Appl. No.: 14/700,113

(22) Filed: Apr. 29, 2015

(65) Prior Publication Data

US 2015/0306484 A1 Oct. 29, 2015

Related U.S. Application Data

(60) Provisional application No. 61/985,948, filed on Apr. 29, 2014.

(51) Int. Cl.

| | |
|---|---|
| ***A63B 69/34*** | (2006.01) |
| ***A63B 71/00*** | (2006.01) |
| ***A63B 69/00*** | (2006.01) |
| ***A63B 69/32*** | (2006.01) |
| ***A63B 23/12*** | (2006.01) |
| ***A63B 71/06*** | (2006.01) |
| *A63B 24/00* | (2006.01) |

(52) U.S. Cl.

CPC ..... *A63B 69/004* (2013.01); *A63B 23/12* (2013.01); *A63B 69/32* (2013.01); *A63B 71/0054* (2013.01); *A63B 71/0622* (2013.01); *A63B 2024/0065* (2013.01); *A63B 2071/0063* (2013.01); *A63B 2071/0072* (2013.01); *A63B 2071/065* (2013.01); *A63B 2071/0625* (2013.01); *A63B 2220/51* (2013.01); *A63B 2220/53* (2013.01); *A63B 2220/56* (2013.01); *A63B 2220/58* (2013.01); *A63B 2225/50* (2013.01); *A63B 2230/06* (2013.01); *A63B 2230/207* (2013.01)

(58) Field of Classification Search

USPC ..... 482/1, 8, 83

See application file for complete search history.

(56) References Cited

U.S. PATENT DOCUMENTS

| | | | | |
|---|---|---|---|---|
| 547,731 | A | 8/1895 | MacLearn | |
| 1,007,311 | A | 10/1911 | Pons | |
| 5,464,377 | A * | 11/1995 | Beeman | A63B 69/004 473/441 |
| D420,413 | S * | 2/2000 | Gonzalez | D21/798 |
| 6,077,204 | A | 6/2000 | Dickinson, Jr. | |
| 7,052,443 | B2 | 5/2006 | Phillips | |
| 7,086,997 | B1 * | 8/2006 | Fields | A63B 69/004 482/83 |
| 7,214,169 | B1 | 5/2007 | Clayton | |
| 7,651,447 | B2 | 1/2010 | Yang | |

(Continued)

*Primary Examiner* — Sundhara Ganesan
*Assistant Examiner* — Shila Jalalzadeh Abyan
(74) *Attorney, Agent, or Firm* — Monty Simmons; Simmons Patents

(57) ABSTRACT

The disclosed technology is a training device particularly well suited for training fighters as well as people simply interested in personal fitness. The device comprises a body portion defining an elongated flexible shape configure to be associated with a cover portion such as a modified focus mitt. The focus mitt defines a planar region further defining a target zone to be hit by the trainee. The body portion provides a flex region configured to absorb at least part of the inertia associated with a strike on the target zone to reduce the load on the trainer and trainee.

20 Claims, 6 Drawing Sheets

(56) References Cited

U.S. PATENT DOCUMENTS

| | | | | |
|---|---|---|---|---|
| 7,789,810 | B2 | 9/2010 | Le | |
| 8,617,034 | B2 | 12/2013 | Eem | |
| 8,641,583 | B2 | 2/2014 | Chen | |
| 8,777,631 | B1 * | 7/2014 | Fletcher | A63B 69/26 434/247 |
| 2004/0209743 | A1 | 10/2004 | Perez | |
| 2009/0088302 | A1 * | 4/2009 | Brenner | A63B 69/34 482/87 |
| 2012/0199105 | A1 * | 8/2012 | Smit | A63B 65/00 124/5 |
| 2013/0059682 | A1 | 3/2013 | Gilman | |
| 2013/0072330 | A1 * | 3/2013 | Cohen | A63B 60/08 473/549 |
| 2013/0109541 | A1 | 5/2013 | Fu | |
| 2015/0057112 | A1 * | 2/2015 | Sak | A63B 24/0003 473/461 |

* cited by examiner

TRAINING DEVICE

CLAIM TO PRIORITY

This application claims priority to provisional application 61/985,948, filed on 29 Apr. 2015, of which the entire contents of such reference are incorporated herein by this reference for all that it discloses for all purposes.

TECHNICAL FIELD

The invention relates to the field of devices for training people wherein such devices include a mitt associated with a hand-held elongated flexible body.

BACKGROUND OF THE INVENTION

One training technique frequently used by people, especially fighters, is to strike targets held by trainers. Such targets are usually hand-held mitts often called focus mitts. Such mitt based training, especially in fields such as boxing and martial arts, has always been hard on the shoulders of the trainer. Indeed, it is often said that holding focus mitts can be as demanding as striking them. Rounds and rounds of focus mitt strikes with heavy punchers can injure the trainer, especially less experienced trainers or older trainers with age related upper extremity joint, tendon, and ligament deterioration.

Notably, boxing training with mitts has become a very popular type of fitness training for non-combatants. However, most general personal fitness trainers have not built up tolerance to repeated blows to the hands, elbows, and shoulder joints as those who have trained boxers for years in combative sports. Consequently, personal fitness trainers who may not have much experience with mitt training but want to offer it as something new for their clients are at risk of injury, especially smaller trainers working with large clients.

What is needed is a training device that minimizes the impact of punches by absorbing or transferring the associated inertia to something other than the trainer/trainee. Such a training device would allow older trainers and inexperienced trainers to train people longer as the physical impact on such trainer is minimized. Similarly, such a training device also allows for the non-combatant personal fitness trainees to push for significant anaerobic and aerobic conditioning during mitt training without injury to upper body extremities (i.e. hands, wrists, elbows, and shoulders).

Another issue involves the trainer's hand speed. The faster the trainer the better the training session will be as the faster the trainee will need to be (or become). Additionally, when using devices such as focus mitts it is important that the trainer not merely to hold them but to actively "feed" them into the combination of punches with visual clues to prompt a desired response from the trainee. Prior art focus mitts on the market do not provide significant improvements in both. For example, prior art focus mitts do not amplify trainer hand speed. Similarly, prior art devices such as the "Ball on the Stick" design disclosed in U.S. Pat. No. 8,777,631, suffers from the defect of not being a planar target which makes signaling the proper punch combinations more difficult thereby forcing the trainer to "call out" additional audio clues such as "hook, uppercut, straight" to indicate what type of punch to throw. Thus, what is needed is a device that amplifies trainer hand speed and allows for trainer signaling to trainee.

In most contact sports, such as boxing, speed and building defensive reaction time of the combatants is a primary goal. Defensive Reaction time is the time from the point the trainee reacts with a defensive move to counter the offensive move of the trainer. Notably, the time it takes a trainer's hand to travel from a neutral position to a striking point (trainer's hand speed) determines the effective defensive reaction time needed from the trainee. In boxing, for example, as a trainer ages his hand speed naturally slows which limits how fast such trainer can push a fighter's defensive reaction time. What is needed is a device that extends a trainer's reach thereby amplifying a trainer's hand speed and ability to "feed" the target to the fighter during training. Such a feature would also allow such trainer to reach areas of the fighter that would otherwise require foot movement, movement which also significantly slows with aging over time.

Another problem with prior art mitts is that they require the trainer to be closer to the fighter than typically desired. What is needed is a device that enhances the trainer's ability to "feed" the target while placing more distance between the trainer/target/mitt and the fighter. Such a feature further stresses the importance of proper distance between fighter and target, how to evade, and further learn the need to get "inside".

Yet another issue relates to feedback to the trainee such a peak punching force, max punching speed, punches per round, and cumulative punching force per round or over multiple rounds. Such would provide clear and objective training benchmarks that the trainee would strive to improve. Consequently, what is needed is a training device that provides the fighter with feedback to signal a performance level.

The training device disclosed in this document addresses at least the problems identified above.

SUMMARY OF THE INVENTION

Some of the objects and advantages of the invention will now be set forth in the following description, while other objects and advantages of the invention may be obvious from the description, or may be learned through practice of the invention.

Broadly speaking, a principle object of the present invention is to provide a training device that reduces physical stresses on the trainer and trainee while improving trainee speed and conditioning.

Another general object of the present invention is to provide a flexible training device comprising a target that a trainee strikes during training.

Another general object of the invention is to provide a flexible training device comprising a target associate with a flexible body that places more distance between the trainer and the trainee.

Still another general object of the invention is to provide a method and flexible training device that provides feedback to the trainee thereby providing an indication of trainee performance and encouraging a more intense workout.

For one embodiment, the hand-held training device comprises a body portion defining an elongated flexible shape configured to be associated with a cover-portion. The body portion comprises a head element, an elongated neck element defining a first neck end and an opposing second neck end, and a handle element. The head element comprises a plate section and an interface section. The first neck end is integrated with or associated with the interface section. The second neck end is integrated with or associated with the handle element.

The cover-portion defines a head element receiver configured for receiving at least part of the head element. Examples of suitable cover-portion technologies include modified focus mitts defining a planar target area. Notably at least part of the neck element defines a flex region configured to provide a predefined flex-action. The cover portion ideally further defines a hand receiver configured for being associated with the hand of a trainer so that the cover-portion may be used without the body portion.

Additional objects and advantages of the present invention are set forth in the detailed description herein or will be apparent to those skilled in the art upon reviewing the detailed description. Also, it should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

Those of ordinary skill in the art will better appreciate the features and aspects of such embodiments, and others, upon review of the remainder of the specification.

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
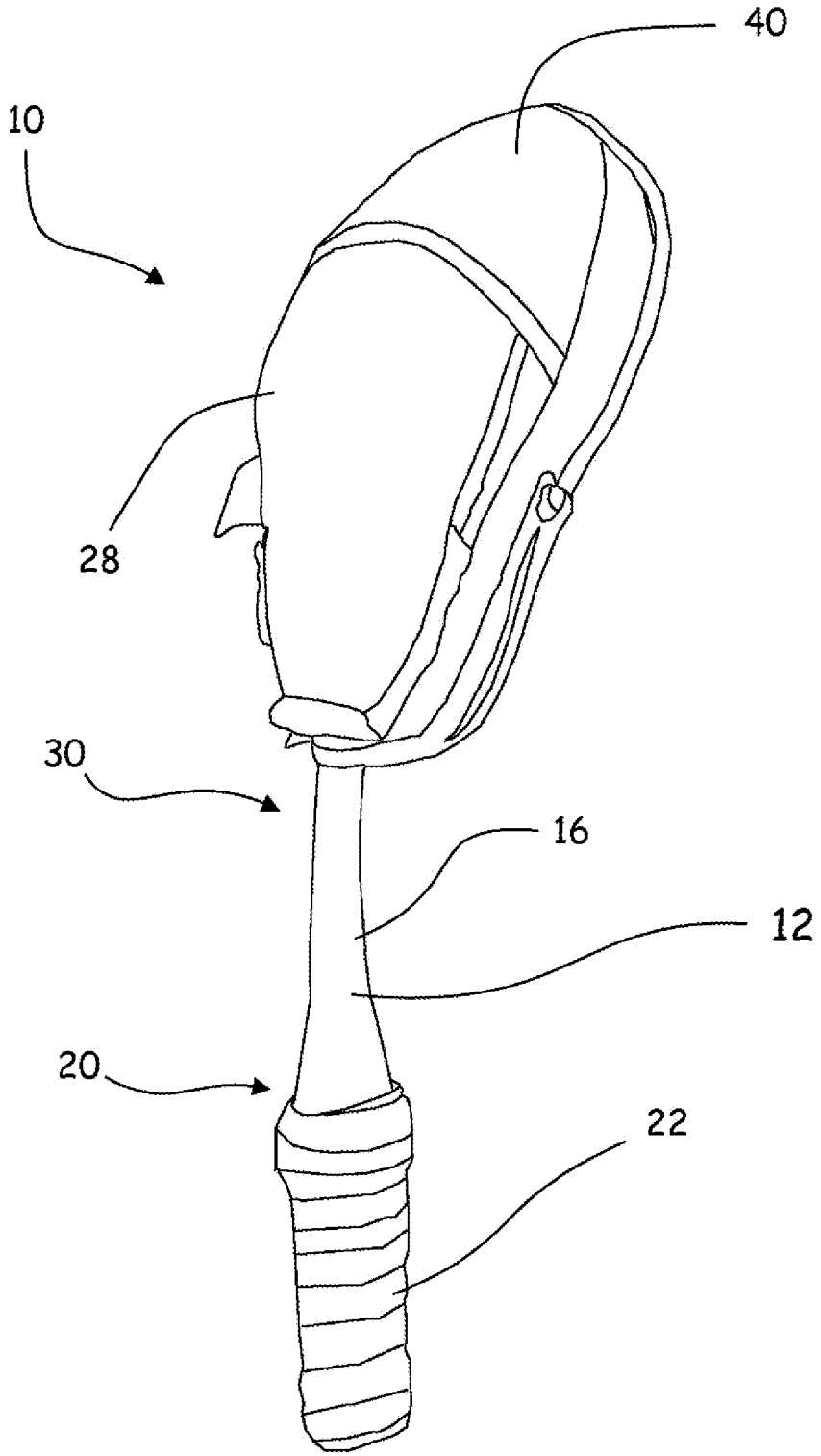
FIG. 1 is a rear perspective view of a hand-held training device comprising a flexible body portion associated with a cover portion according to one exemplary embodiment of the invention.

Repeat use of reference characters throughout the present specification and appended drawings is intended to represent the same or analogous features or elements of the present technology.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only, and is not intended as limiting the broader aspects of the present invention.

For the purposes of this document two or more items are "mechanically associated" by bringing them together or into relationship with each other in any number of ways including a direct or indirect physical "releasable connections" (snaps, screws, Velcro®, bolts, etc.—generally connections designed to be easily and frequently released and reconnected), "hard-connections" (welds, rivets, macular bonds, generally connections that one does not anticipate disconnecting very often if at all and that generally needs to be "broken" to separate), and/or "moveable connections" (rotating, pivoting, oscillating, etc.).

This document includes headers that are used for place markers only. Such headers are not meant to affect the construction of this document, do not in any way relate to the meaning of this document nor should such headers be used for such purposes.

While the particulars of the present invention and associated technology may be more frequently described for use with boxers and fighters, the disclosed technology may be used in any number of fields associated with training people including personal fitness training by non-professionals.

Figure 2:
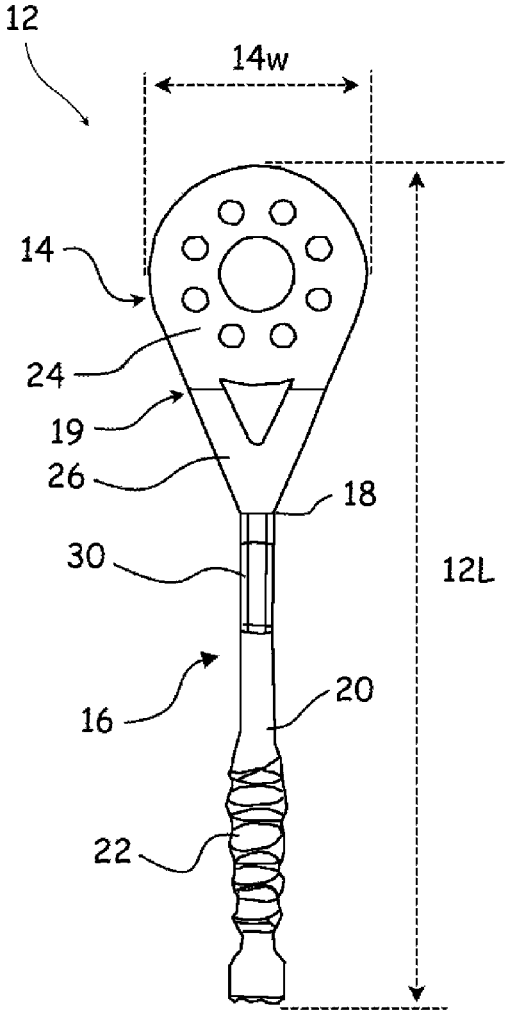
FIG. 2 is a top plan view of the flexible body portion of FIG. 1 without the cover portion.

Referring now to FIG. 1, one exemplary embodiment of a hand-held training device (10) (aka "training device" generally), is presented. For the currently preferred embodiment, training device (10) comprises a body portion (12) associated with a cover portion (28). As best presented in FIG. 2 and FIG. 3, for the current embodiment, body portion (12) defines an elongated flexible shape (similar to a spatula shape) where body portion (12) comprises a head element (14), an elongated neck element (16) defining a first neck end (18) and an opposing second neck end (20), and a handle element (22). It will be appreciated that body portion (12) may define one integral component comprising the various sections identified above or, alternatively, one or more of the individual sections/elements may be mechanically associated together to form body portion (12). Any suitable material may be used to form body portion (12) and cover-portion (28). Examples included a lightweight durable plastic/injection molding for the body portion and foam rubber and leather or synthetic leather for the cover portion.

For the currently preferred embodiment, head element (14) comprises a plate section (24) and an interface section (26). Head element (14) defines a head element width (14*w*) and a head element thickness (14T, FIG. 3). For the current embodiment, it should be appreciated that the head element width and plate section width are equal. Similarly, the head element thickness and plate section thickness are equal. Further, for the currently preferred embodiment the interface section thickness is substantially equal to the plate section thickness.

The outer perimeter of head element (14) defines a polygonal shape up to the point (19) where plate section (24) meets the interface section (26). While such polygonal shape could define any polygonal shape (e.g. quad, pentagon, hexagon, hepta, octagon, etc.), for the preferred embodiment the polygonal shape is a circular shape (for the purposes of this document a polygon includes circles). The interface section (26) defines a triangular perimeter with the base associated with the plate section (24) with the triangle point opposing the base pointing away from the plate section (24). The point of such triangular shape is associated with first neck end (18). Notably, the plate section (24) and interface section (26) may be defined by one integral component or a plurality of components mechanically and perhaps removably associated with each other.

Figure 4:
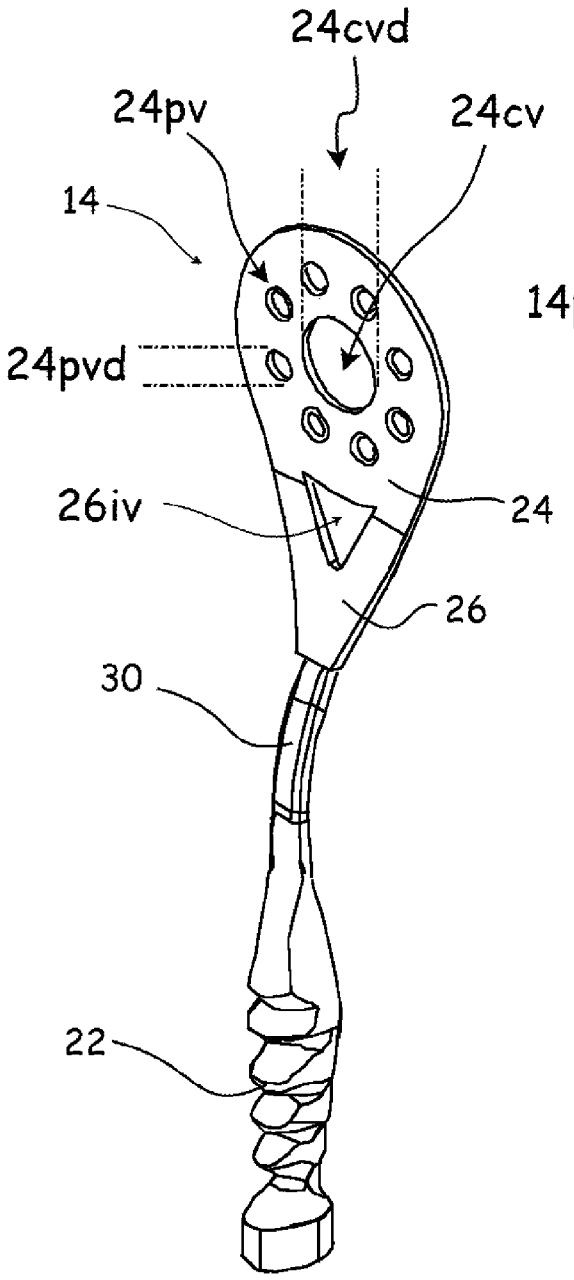
FIG. 4 is a right side perspective view of the flexible body portion in FIG. 2.
Figure 5:
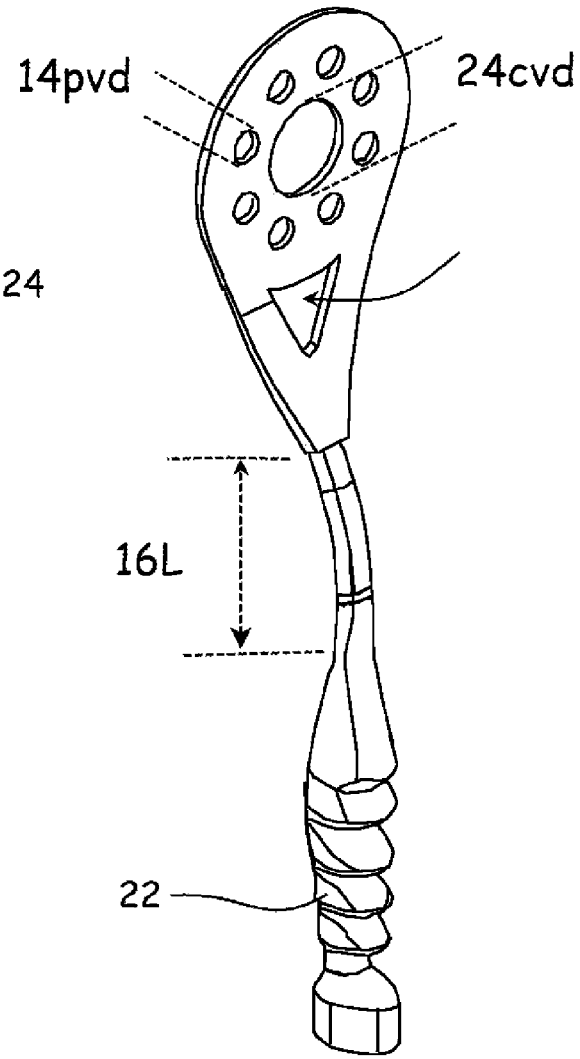
FIG. 5 is a left side perspective view of the body portion in FIG. 2.

As best view in FIG. 4, head portion (12) may define a plurality of voids there through. For the currently preferred exemplary embodiment, plate section (24) defines one center void (24*cv*) having a diameter (24*cvd*) and a plurality of perimeter-voids (24*pv*) each defining a diameter of (24*pvd*). It should be appreciated that the perimeter-voids may define different diameters. Similarly, interface section (26) defines interface-void (26*iv*). For the preferred embodiment, interface-void (26*iv*) defines a void of similar shape to the perimeter of interface section (26). Since the interface section (26) perimeter defines a rectangular shape, interface void (26*iv*) defines a rectangular void area. The size and location of such voids are selected to (a) reduce overall weight and associated material costs and (b) set the center of mass for the body portion (12) to a desired location. As will be discussed later, preferably, the center of mass of training-device (10) would be within flex region (30).

Referring now to elongated neck element (16), the first neck end (18) is one of (a) integrated with interface section (26) and (b) mechanically associated with interface section (26). Similarly, the second neck end (20) is one of (a) integrated with handle element (22) and (b) mechanically associated with handle element (22). As best seen in FIG. 2 through FIG. 5, at least part of elongated neck element (16) defines a flex region (30). Such flex region (30) is configured to provide a predefined flex action described in more detail later. Neck element (16) defines a neck element thickness (16T, FIG. 3), neck element angle (16*a*, FIG. 3), and a neck element length (16L, FIG. 5).

Handle-element (22) is configured to be gripped by a trainer and therefore defines a grip comprising a plurality of finger receivers. Hand-element (22) defines a handle-element length (22L, FIG. 3) long enough to provide for a plurality of griping positions and associated features. When the trainer grips the finger-center location (34*a*), such location provides the best reach-to-speed ratio. When the trainer grips the finger top location (34*b*), reach is reduced but speed is enhanced. When the trainer grips the finger bottom position (34*c*), basically holding at the "butt" of the device, reach is enhanced but speed is reduced.

Figure 6:
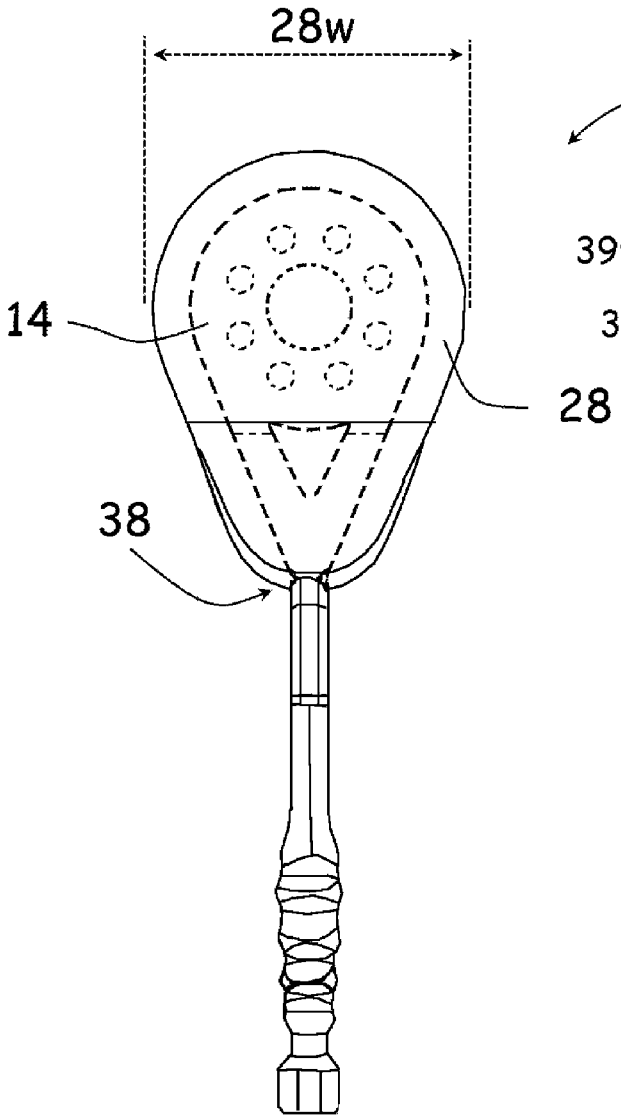
FIG. 6 is a top plan view of with a flexible body portion associated with an alternative embodiment of a cover portion.
Figure 7:
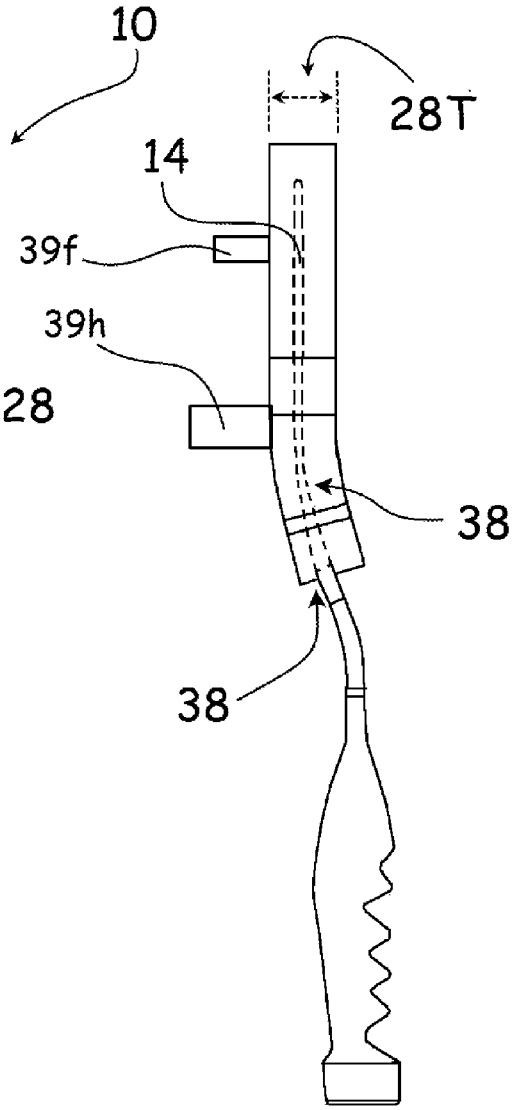
FIG. 7 is a side elevational view of the hand-held training device depicted in FIG. 6.

Referring now to FIG. 1, FIG. 6 and FIG. 7, training device (10) further comprises a cover-portion (28) defining a head element receiver (38) configured for receiving at least part of head element (14) so that the cover-portion (28) at least partially surrounds head element (14). As best seen in FIG. 6 and FIG. 7, one embodiment of a head element receiver (38) is a pocket suitably sized to receive head element (14). For the embodiment depicted in FIG. 1, cover-portion (28) extends to the elongated neck element (16) thereby covering all of head element (14). Cover-portion (28), which may or may not be padded, defines a "target" a trainee is to strike.

Any suitable technology may be used for cover-portion (28) including punch mitts, focus mitts, speed mitts, and contoured mitts configured with a head element receiver (38). Whatever technology selected, cover-portion (28) preferably defines a planar target region for the reason describe below.

As previously noted, generally speaking, when using devices such as focus mitts it is important that the trainer not merely hold them but to actively "feed" them into the combination of punches with visual signals to prompt the proper response from the trainee. Prior art devices, including the "Ball on the Stick" designs, suffer from the defect of not providing a planar target region which makes signaling the proper punch combinations more difficult. Additionally, preferably, cover-portion (28) defines a target plane supported by plate section (24) thereby providing a planar striking surface (target region) preferably with focus markings (e.g. round highly colored circles) which are used to provide visual signals simply through target position and directional facing of the target plane.

For example a trainer does not have to call out a "hook" but simply positions the "target plane" facing to the trainer's side. Similarly an uppercut can be visually signaled by having the target plane facing down. Because the stick and ball design is symmetric about all its axis, the trainee is less certain which punch the trainer desires without additional audio signaling. Audio calls, however, have the undesirable effect of slowing down the training. If the hand is quicker than the eye it is certainly quicker than the ear as the speed of sound is much slower than the speed of light. Further, while visual signals may "slow down" training (to some extent), a boxer, for example, is generally responding to visual signals in competition there by making visual signals more realistic to real world fight conditions.

Notably, the cover-portion (28) of FIG. 6 and FIG. 7 represent slightly different embodiments compared to FIG. 1. Such alternative embodiment of cover-portion (28) further defines a hand receiver comprising a hand interface (39*h*) and a finger interface (39*f*) referred to collectively as hand receiver (39). Hand receiver (39) is preferably defined on the back side of cover-portion (28) and is configured to allow a trainer to slide his/her hand though hand interface (39*h*) until his/her fingers also slide through finger interface (39*f*). Such features allow the trainer to use the cover-portion (28) without body portion (12).

Referring back to FIG. 1, as well as FIG. 6 and FIG. 7, cover-portion (28) may further define a cover-portion tip section (40) configured to allow a trainer to strike a trainee and provide tip-feedback. For example, ideally a boxer should not "square up" to his opponent thereby exposing the full width of his chest to the other boxer. When using training-device (10), should the trainee square up to the trainer, the trainer jabs the fighter in the chest with cover-portion tip section (40) to provide "tip-feedback". For the preferred embodiment, such section is constructed to generate the level of feedback desired. For example, such tip section would be padded to define a desired hardness. Alternatively, such tip section could be configured to deliver an electric shock.

Exemplary Measurements and Center of Mass

While any size training device (10) may be used, exemplary measurements for one embodiment particularly suited for training boxers is considered. For such preferred embodiment, the overall length of hand-held training device (10) is between about 20 inches to about 28 inches depending on the length of body portion (12). The overall length (12L, FIG. 2) of body portion (12) is between about 21.0 inches and 26 inches.

The plate section is between about 5 inches to about 7 inches long and wide (i.e. defines a circular perimeter) and has a thickness (14T, FIG. 3) of about one-eighth of an inch to about five sixteenths of an inch.

The head interface section defines a triangular perimeter with a height (length from base to tip) of between about 3 inches to about 5 inches long and a width (base) of about 5 inches to about 7 long where it associates with plate section (24). The head interface section is about the same thickness as the plate section.

The neck element (16) is between about 4 inches to about 10 inches long and three-eighths inches to about five-eighths inches wide. The neck element further defines a neck angle bend (16*a*) that is about 10 degrees to about 45 degrees.

The handle element (22) is between about 6 inches to about 8 inches long and ideally provides for three griping regions as previous described.

For the current embodiment, the above described dimensions and materials are selected so that training device (10) is about 300 grams with the center of mass ideally located in the flex region (30) when body portion (12) is associated with cover-portion (28).

On method of defining the location of the center of mass is to vary the sizes and locations of the center-void (24*cv*), the perimeter-voids (24*pv*) and the interface void (26*iv*).

Flex Region

As previously noted, elongated neck element (16) defines flex region (30). The flex region is formed with ridges and structural supports to define a desired flex action for the material being used to form the device. The purpose of flex region (30) is to absorb a predefined amount of inertia from a target strike instead of transferring such inertia to the trainer holding training device (10) or the trainee striking such device. Such flex action reduces the force loads on a trainer's wrists, arms and shoulders. As noted above, elongated neck element (16) ideally defines a neck angle (16*a*) and such angle is between about 10 degrees to 45 degrees so that such angle tilts the cover-portion toward the handle element (22) finger slots as depicted in FIG. 1.

Figure 3:
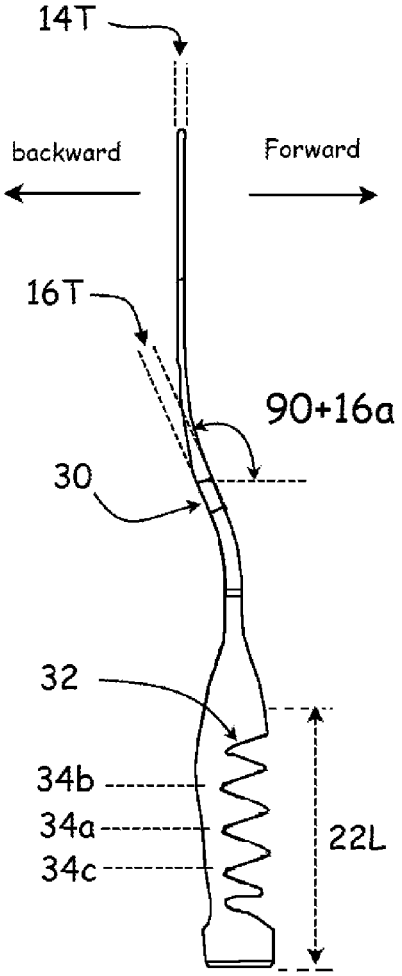
FIG. 3 is a side elevational view of the flexible body portion in FIG. 2.

For the preferred embodiment, flex region (30) is constructed so that a 5 pound weight will cause about 11.5 inches of deflection when secured to the center of target area of the cover-portion (28) and body portion (12) is perpendicular to the pull of gravity vector and oriented so that the weight's force pulls in the same direction as angle (16*a*) (which is hereby defined as the forward deflection, FIG. 3). Further, such 5 pound weight will cause about 14 inches of deflection when secured to the center of target area of the cover-portion (28) and oriented so that the weight's force will pull in the opposite direction as angle (16*a*) (which is hereby defined as the backward deflection). Such flex action is defined as a 5/11.5/14 flex action where 5 is the force applied to the center of the target area in pounds, 11.5 is the forward deflection in inches and 14 is the backward deflection in inches with a tolerance of 20% (in both directions).

Electronic Features

Figure 8:
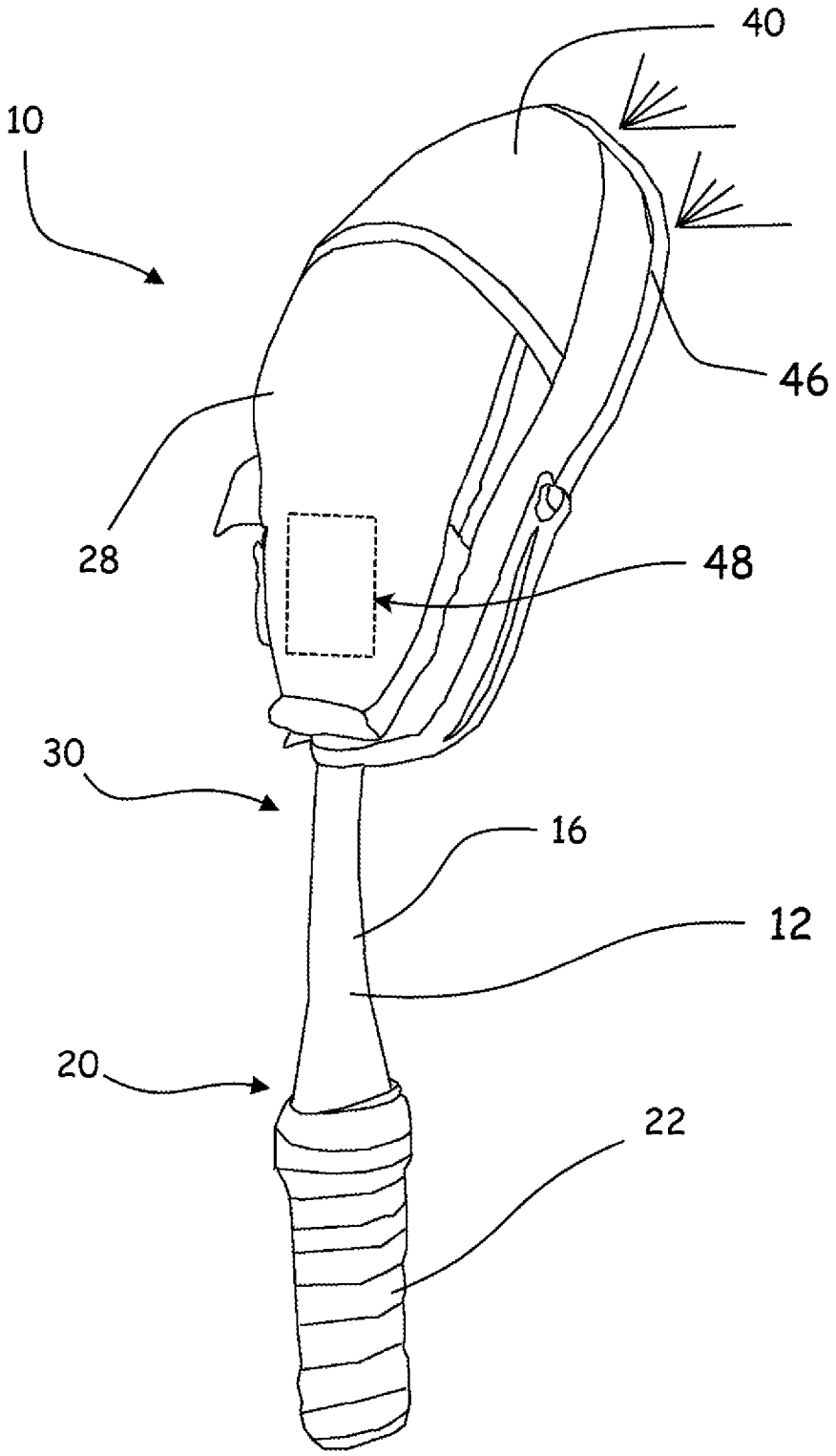
FIG. 8 is a back side perspective view of the hand-held training device of FIG. 1 associated with an electronic module.
Figure 9:
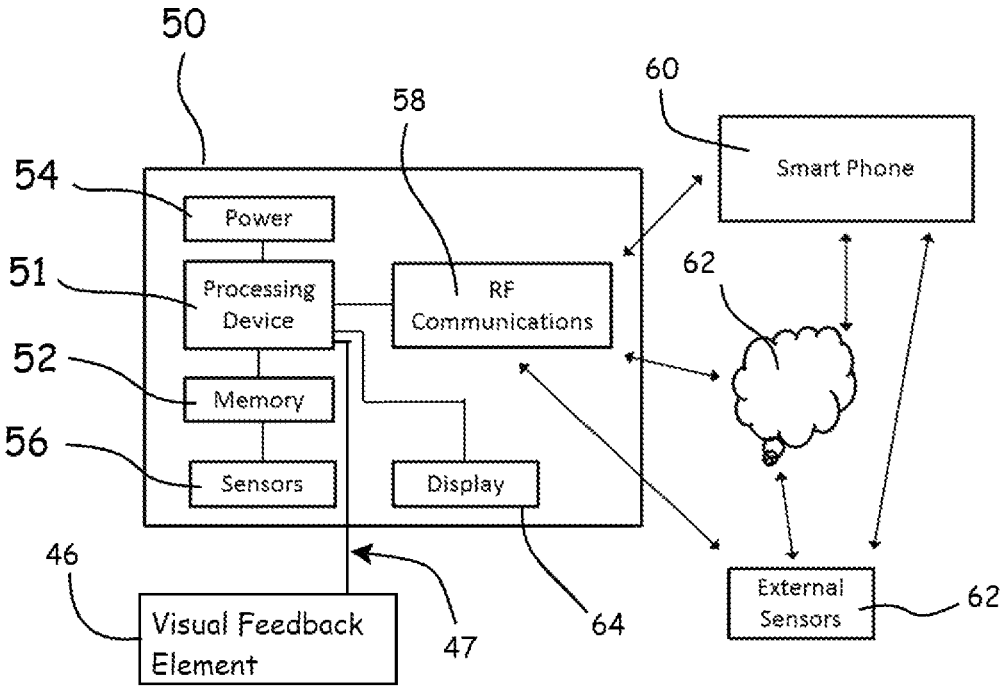
FIG. 9 is a block diagram representation of an electronic module and associated features.

Referring now to FIG. 8 and FIG. 9, the electronic features are explored in detail. For this alternative embodiment, an electronic module (50) is associated with training device (10). The module is associated with module holder (48) defined by cover-portion (28). The electronic module (50) comprises a processing device (51) electrically associated with a memory (52), a power source (54) and at least one sensor (56). It should be appreciated that any number of such components may be integrated into one component without departing from the scope and sprit of the invention.

The functional blocks of FIG. 9 represent components well known in the art such as ASSPs (Application Specific Standard Product), Complex Programmable Logic Devices (CPLD), ASICs (application specific integrated circuit), microprocessors, or PICs. In addition, one or more functional blocks may be integrated into a single device or chip sets such as ASSP chip sets.

Processing device (51) may comprise onboard FLASH, ROM, RAM, EPROM type memories (i.e. memory (52) which may be integrated into the processing device). For one embodiment memory (52) has sufficient storage capacity to store the profile data of a plurality of trainees including name, age, target heart rate, and similar values. Additionally, memory (52) should have sufficient storage capacity to store at least an hour long training session of data for a plurality of trainees. That said, memory (52) may be of sufficient storage capacity to store as much data as economically feasible. Such devices and their electrical connections/associations are well known in the art and are not particularly novel although their used as described below is novel.

Electronic module (50) may further comprise a display device (64) for displaying device parameters and trainee data. Such display device may be a simple set of LEDs or as complex as a full LCD display (such as Samsung's Youm Flexible OLED Displays). For one embodiment, display (64) is configured for displaying the various system data received or generated by processing device (51). Display (64) may include technology for providing a customizable touch screen controller and may further comprise a graphics accelerator that provides support for megapixel cameras and 3D graphics applications. One suitable graphics accelerator is the MQ2100 manufactured by MediaQ. For such a configuration, sensors (56) may include and imaging sensor/device configured to record images and a sound sensor/device configured to store sound where such data is stored in memory (52) and displayed on display (64) upon user request.

The processing device (51) is further electrically associated with a visual feedback element (46) defined along a surface of cover-portion (28) via wired or wireless communication connection (47). For one embodiment, feedback element (46) comprises one or more light emitting elements configured to generate one or more colors of light.

For the currently preferred embodiment, sensor (56) is a pressure sensor such as an accelerometer configured to sense the force of a strike to training device (10) and generate corresponding sensor signals that are received and used by processing device (51). Such pressure sensors are well known in the art and a detailed description thereof is not required to provide an enabling description to one of ordinary skill. For one embodiment, processing device (51) compares the received signals and generates a feedback signal that is transferred to visual feedback element (46). For example, an extreme strike value ("ESV") is stored in memory (52) and corresponds to a strike having maximum force. Similarly, a medium strike value ("MSV") is stored in memory (52) and corresponds to a strike having a medium strike force. A Low Strike Value ("LSV") is stored in memory (52) and corresponds to a strike having a lower than medium strike force. Notably, the measured strike values, the number of strikes, and workout time durations may be recorded by electronic module (50) for later transfer to an external device.

With the above configuration, a trainee punches the training device (10). Sensor (56) generates a corresponding sensor signal which is received by processing device (51). Processing device (51) generates a feedback signal that is transferred to visual feedback element (46). If the received sensor signal corresponds to an ESV value, a "red" feedback signal is transferred to visual feedback element (46) which activates "RED" light emitting elements (such as LEDs). If the received sensor signal corresponds to an MSV value, a "yellow" feedback signal is transferred to visual feedback element (46) which activates "Yellow" light emitting elements. If the received sensor signal corresponds to an LSV value, a "blue" feedback signal is transferred to visual feedback element (46) which activates "blue" light emitting elements. One of ordinary skill in the art will appreciate that the above technology can be used to generate any number of feedback schemes without departing from the scope and sprit of the invention.

For one embodiment, the electronic module provides a calibration mode to allow the strike values to be set for each individual trainee. Alternatively, such strike values could be set to a particular value which may correspond to a well-known athlete such as a champion boxer.

For yet another embodiment, the electronic module (50) further comprise communication circuitry (58). Exemplary communication circuitry includes relatively long range wireless communication circuitry such as cell phone/WiFi and/or relatively short range communication circuitry such a Bluetooth. Notably, such technology may be integrated into processing device (51). Communication circuitry is preferably configured to transmit and receive data signals to/from a remote electronic device although embodiments where such communication circuitry comprises only a transmitter or only a receiver fall within the scope of the invention. Ideally, the relatively low power transmitter transmits a data signal in an unlicensed frequency band. Suitable communication circuitry includes Bluetooth, GPRS, GSM, GPRS, 3G, EDGE enabled networks as well as WAP networks.

Using communication circuitry (58), electronic module (50) is preferably configured to communicate to external devices such as smart phones directly or over a network (62) such as a local network or a wide area network (Internet). One of ordinary skill in the art will appreciate that such a configuration enables continuous remote monitoring of the electronic module and associated sensors from anywhere in the world.

For one embodiment, electronic module (50) is configured to communicate with a smart phone (60) to configure training-device (10) and/or update its firmware and transfer data in and out of memory (52). For such configuration, the trainer installs the training-device (10) application on his smartphone. Such application is programmed to allow the smart phone (60) to find and pair with training-device (10) and/or external sensors (62) and transfer data between such devices. Smart phone applications, in general, are well known in the art and a detailed description of the application is not necessary to provide an enabling description of the invention. What is novel are the data and data types transferred and how such data is used as explained above and in more detail below.

Electronic module (50) may be further in communication with an external sensor (62). Such external sensors (62) include bio-sensors associated with a trainee configured to transfer bio-data to processing device (51) which ideally stores such data in memory (52). Such bio-data includes the trainee's heart rate, skin temp, body temp, room temp, respiration rate, and Oxygen saturation levels.

Alternatively, external sensors (62) contain their own communication technology and transfer such data to directly smart phone (60). For such embodiment, external sensors (62) and processing device (51) synchronize their time keeping routines so that the data generated by processing (51) is in time sync with the data generated by external sensors (62) allowing data correlation. Alternatively, the training device (10) and external sensors (62) synchronize their time keeping technology with smart phone (60).

External sensors (62) may further be associated with items associated with the trainee such as boxing gloves. For this embodiment, processing device (51) or smart phone (60) may use the associated data to determine trainee hand speed.

Using such technology and a professional boxer as the trainee, data such as total punch output per round, accumulated force per workout, reductions in hand speed over time, heart rate over time, oxygen levels variations over time can be monitored and time synchronized.

For yet another feature, professional boxers, for example, may generate a workout profile that stored in a device with electronic access to smart phone (60). Such profiles may be accessed and transferred to the training device (10). The application allows the trainer to select the power level values of a professional boxer (perhaps a boxer the fighter is to fight next) which are uploaded to training device (10). Such a feature would allow a boxer to better appreciate the power level of the punches for his upcoming opponent as well as the opponent's conditioning level.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A hand-held training device, said hand-held training device comprising:

a body portion defining an elongated flexible shape comprising a head element, an elongated neck element defining a first neck end and an opposing second neck end, and a handle element;

wherein said head element comprises a plate section and an interface section wherein said first neck end is one of (a) integrated with said interface section and (b) securely mechanically associated with said interface section thereby defining a hard connection between said head element and said first neck end and wherein said second neck end is one of (a) integrated with said handle element and (b) securely mechanically associated with said handle element thereby defining a hard connection between said handle element and said second neck end;

a cover-portion defining a head receiver configured for receiving at least part of said head element so that said cover-portion at least partially surrounds said head element and wherein said cover-portion defines a planar target area that a trainee strikes; and wherein a portion of said neck element defines a flex region configured to provide a predefined flex-action that is more flexible than the remainder of the neck element, wherein a center of mass of the hand-held training device is defined within said flex region and wherein said neck element further defines a neck angle relative to the handle element.

2. A hand-held training device as in claim 1, wherein the neck angle is between about 10 degrees to about 45.

3. A hand-held training device as in claim 2, wherein said plate section defines a center-void there through disposed at a approximate center of said plate section.

4. A hand-held training device as in claim 3, wherein said plate section further defines a plurality of perimeter voids there through each disposed between the center-void and an outer perimeter of said plate section.

5. A hand-held training device as in claim 4, wherein the size and position of said center-void and said plurality of perimeter voids are selected so that said center of mass of said hand-held training device is disposed within said flex region and so that the hand-held training device has an overall weight of about 300 grams.

6. A hand-held training device as in claim 1, wherein said cover-portion further defines a hand receiver configured for receiving a trainer's hand so that said cover-portion can be used without said body portion.

7. A hand-held training device as in claim 6, wherein said cover-portion defines a focus pad.

8. A hand-held training device as in claim 1, wherein said hand-held training device defines an overall length between about 22 inches to about 28 inches and wherein said head element defines a length between about 5.5 inches to about 6.5 inches, said interface section defines a length between about 3.5 inches to about 4.5 inches, said neck element defines a length between about 4.5 inches to about and 5.5 inches, and said handle element defines a length between about 6 inches to about 8 inches.

9. A hand-held training device as in claim 8, wherein said head element defines a width between about 5 inches and about 6 inches, said neck element defines a width between about three-eighths inches to about five-eighths inches, and said handle element defines a width between about one-half inches to about one inches.

10. A hand-held training device as in claim 1, wherein said flex region defines a flex-action so that a 5 pound weight will cause about 11.5 inches of deflection.

11. A hand-held training device as in claim 1, further comprising an electronic module configured for providing visual feedback to the trainee indicating at least one of (a) an extreme strike, (b) a medium strike, and (c) a less than medium strike.

12. A hand-held training device, said hand-held training device comprising:

a body portion defining an elongated flexible shape comprising a head element, an elongated neck element defining a first neck end and an opposing second neck end, and a handle element;

wherein said head element comprises a plate section and an interface section wherein said first neck end is one of (a) integrated with said interface section and (b) securely mechanically associated with said interface section thereby defining a hard connection between said head element and said first neck end and wherein said second neck end is one of (a) integrated with said handle element and (b) securely mechanically associated with said handle element thereby defining a hard connection between said handle element and said second neck end;

a cover-portion defining a head receiver configured for receiving at least part of said head element so that said cover-portion at least partially surrounds said head element and wherein said cover-portion defines a planar target area that a trainee strikes; and wherein at least part of said neck element defines a flex region further defining a neck angle relative to the handle element, wherein said flex region is configured to provide a predefined flex-action, and wherein a center of mass of the hand-held training device is defined within said flex region.

13. A hand-held training device as in claim 12, wherein said cover-portion further defines a hand receiver configured for receiving a trainer's hand so that said cover-portion can be used without said body portion.

14. A hand-held training device as in claim 13, wherein said plate section defines a center-void there through disposed at the approximate center of said head portion and a plurality of perimeter voids there through each disposed between the center-void and an outer perimeter of said head element and wherein a size and location of said center-void and each of said plurality of perimeter voids are selected so that the center of mass of the hand-held training device is disposed within the said flex region, wherein said neck angle is between about 10 degrees to about 45 degrees and wherein said training device has an overall weight of about 300 grams.

15. A hand-held training device as in claim 12, further comprising an electronic module configured for providing visual feedback to the trainee indicating at least one of (a) an extreme strike, (b) a medium strike, and (c) a less than medium strike.

16. A hand-held training device, said hand-held training device comprising:

a body portion defining an elongated flexible shape comprising a head element, an elongated neck element defining a first neck end and an opposing second neck end, and a handle element;

wherein said head element comprises a plate section that is connected to said first neck end and wherein said second neck end is connected to said handle element;

wherein said plate section defines a center-void there through disposed at the approximate center of said head element and wherein said plate section further defines a plurality of perimeter voids there through each disposed between the center-void and an outer perimeter of said head element;

a cover-portion defining a head receiver configured for receiving at least part of said head element so that said cover-portion at least partially surrounds said head element and wherein said cover-portion defines a planar target area that a trainee strikes;

wherein at least part of said neck element defines a flex region that is more flexible than the remainder of said neck element, wherein said flex region further defines a neck angle between about 10 degrees and 45 degrees relative to said handle element and wherein said flex region is configured to provide a predefined flex-action; and wherein a size and location of said center-void, each of said plurality of perimeter voids are selected so that a center of mass of the hand-held training device is defined within said flex region and the overall weight of said hand-held training device is about 300 grams.

17. A hand-held training device as in claim 16, wherein said cover-portion further defines a hand receiver configured for receiving a trainer's hand so that said cover-portion can be used without said body portion.

18. A hand-held training device as in claim 17, further comprising an electronic module comprising a processing device, memory, at least one sensor and a power source and wherein said electronic module is electrically associated with a visual feedback device and wherein said at least one sensor is configured to generate strike data representative of a force of a strike to said planar target area and wherein said processing device is configured to use such strike data to activate said visual feedback element to generate a visual feedback signal indicating at least one of (a) an extreme strike, (b) a medium strike, and (c) a less than medium strike.

19. A hand-held training device as in claim 18, wherein said electronic module further comprises communication technology wherein said electronic module is further configured to store the strike data for a training session and wherein said processing device is configured to use said communication technology to transfer said strike data to an external electronic device.

20. A hand-held training device as in claim 19, wherein said electronic module is configured to communicate with a smart phone and transfer data between said electronic module and said smart phone and wherein said electronic module is further configured to communicate with and transfer data to at least one external sensor so that time keeping routines for said electronic module and said external sensor can be synchronized.

* * * * *